US005307700A

United States Patent [19]

Spellman et al.

[11] Patent Number: 5,307,700

[45] Date of Patent: May 3, 1994

[54] ELECTRIC ENGINE STARTER

[75] Inventors: James A. Spellman, Noblesville; Ross A. Gresley; Norman E. Goodwin, Jr., both of Anderson, all of Ind.

[73] Assignee: General Motors Corporation, Detroit, Mich.

[21] Appl. No.: 985,711

[22] Filed: Dec. 4, 1992

[51] Int. Cl.[5] ..... F02N 15/06

[52] U.S. Cl. ..... 74/7 A; 74/7 R

[58] Field of Search ..... 74/6, 7 R, 7 A

[56] References Cited

U.S. PATENT DOCUMENTS

| | | | |
|---|---|---|---|
| 4,779,470 | 10/1988 | Morita et al. | 74/7 A X |
| 5,005,435 | 4/1991 | Sugiyama | 74/7 |
| 5,048,355 | 9/1991 | Ueno | 74/7 |
| 5,052,234 | 10/1991 | Sugiyama | 74/6 |
| 5,053,633 | 10/1991 | Sugiyama et al. | 290/48 |
| 5,167,162 | 12/1992 | Nagashima et al. | 74/7 A |

FOREIGN PATENT DOCUMENTS

| | | | |
|---|---|---|---|
| 2822163 | 11/1979 | Fed. Rep. of Germany | 290/48 |

*Primary Examiner*—Allan D. Herrmann

*Attorney, Agent, or Firm*—Creighton R. Meland

[57] ABSTRACT

An electric engine starter for cranking an internal combustion engine. The starter has a drive housing which is shaped to define a solenoid compartment and a starter drive compartment. The drive housing has a pair of spaced walls connecting the solenoid compartment to the starter drive compartment. A starter drive that includes a pinion gear and an overrunning clutch is located in the starter drive compartment. A shift lever retainer is located between the spaced walls of the drive housing and pivotally supports a shift lever. The retainer has outwardly projecting ribs and the spaced walls have inwardly projecting spaced ribs. These ribs impede the passage of water from the starter drive compartment to the solenoid compartment. The shift lever has a plate or flap which, in an at-rest position of the shift lever, forms a barrier for the passage of water from the starter drive compartment toward the retainer. The drive housing has two water drain openings that are connected by a drain channel that operates as a sump.

6 Claims, 2 Drawing Sheets

ELECTRIC ENGINE STARTER

BACKGROUND

This invention relates to an electric engine starter for cranking an internal combustion engine and more particularly to an electric starter that is constructed to protect the starter from substances such as water that can enter the starter.

Electric engine starters or cranking motors are provided with a starter drive housing which encloses a starter drive that has a pinion. This housing has an access opening which allows the pinion to be shifted into mesh with the ring gear of the engine. Engine starters are mounted on an engine of a motor vehicle and are located close to the ground. Therefore, the starter can be subjected to road splash with the result that various substances or materials such as water, saltwater, road oil, and debris can enter the starter through the access opening. These substances or contaminants can cause, among other things, the overrunning clutch to corrode and stick to the shaft and the substances can corrode the plunger of the solenoid to a point that it will not pull in and thus, prevent the pinion from meshing with the ring gear.

SUMMARY

One of the objects of this invention is to provide a means for draining fluid from the interior of the drive housing. In carrying this object forward, the drive housing is provided with an axially extending drain channel which is open at its opposite ends to drain slots. The drain channel operates as sump and fluid, such as water, that collects in the drain channel flows out of the drive housing through the drain slots.

In accordance with another aspect of this invention, the engine starter of this invention is constructed to reduce the amount of substances, such as water, that can reach the starter solenoid. In carrying this object forward, a retainer that pivotally supports a shift lever is provided with ribs. These ribs are disposed adjacent certain surfaces of the drive housing and tend to prevent flow of fluid toward the solenoid plunger. The just mentioned surfaces on the drive housing are also provided with ribs which tend to deflect any fluid splash that may pass around the ribs on the retainer. The shift lever is provided with an integral splash deflector plate or flap portion. This plate portion, when the starting motor is at rest, covers an area of the retainer to prevent fluid, such as water, from entering and passing by the retainer.

DETAILED DESCRIPTION OF A PREFERRED EMBODIMENT

Figure 1:
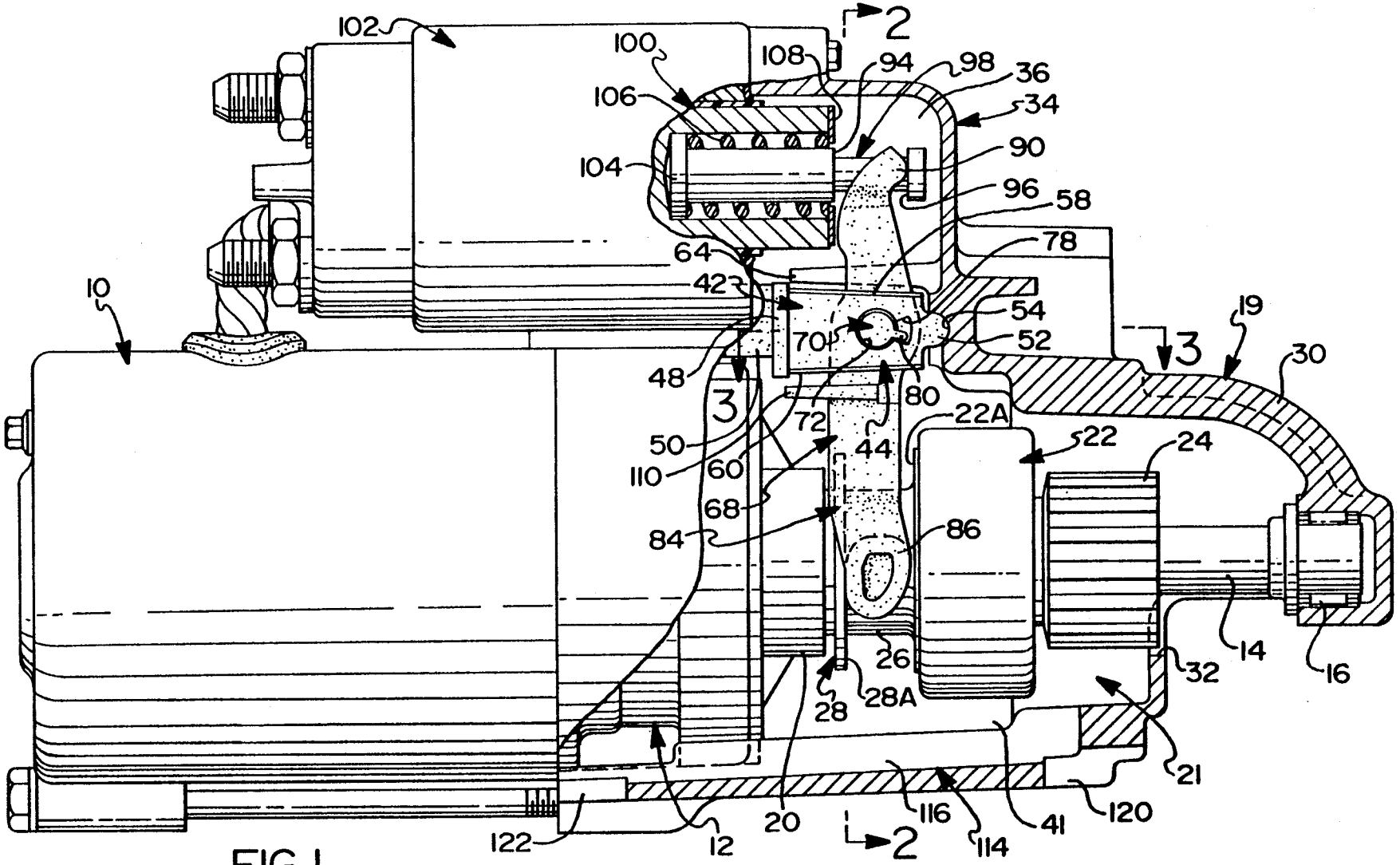
FIG. 1 is a side view, with parts broken away, of an electric engine starter made in accordance with this invention.

Referring now to the drawings and more particularly to FIG. 1, an electric engine starter or cranking motor is illustrated. The starter has a direct current motor 10 that has an armature and an armature shaft which are not illustrated. The motor 10 further has a means for developing field flux (not illustrated) which may take the form of a plurality of permanent magnets.

The armature shaft of direct current motor 10 is connected to the sun gear of a planetary gear mechanism 12. The sum gears of the planetary gear mechanism drive a pinion drive shaft 14. The drive shaft 14 is supported for rotation by a bearing 16 in a drive housing generally designated as 19 and by another bearing (not illustrated) located in part 20.

The shaft 14 drives a starter drive, generally designated as 21, that is comprised of an overrunning clutch 22 and a pinion gear 24 that is adapted to be moved into mesh with the ring gear of an engine. The shell 26 of the overrunning clutch has a helical splined connection to shaft 14, which is not illustrated. The shell 26 carries a disk 28 having a surface 28A and clutch 22 has a surface 22A that faces surface 28A. Surfaces 22A and 28A are engaged by portions of a shift lever in a manner to be more fully described hereinafter.

The drive housing which is generally designated as 19, has an end nose portion 30. The end portion 30 has an access opening 32. This opening 32 allows pinion gear 24 to be moved into mesh with a ring gear of an engine. Pinion 24 is moved into opening 32 when it is moved into mesh with the ring gear. The drive housing 19 has a portion 34. Portion 34 provides and defines a so-called solenoid chamber or compartment 36. The drive housing 19 further has walls 38 and 40 shown in FIG. 2. The walls 38 and 40 are disposed between chamber 36 and a starter drive compartment 41. Disposed between walls 38 and 40 is a shift lever retainer generally designated as 42. Retainer 42 is formed of a plastic material and is a one-piece molded plastic part.

Retainer 42 has opposed arms 44 and 46 that extend from end portion 48. The end surface of the end portion 48 engages a rubber plug 50 that is carried by drive housing 19. As can be seen in FIG. 1, the arm 44 has an end portion 52 that has a curved surface that is located in a groove 54 that has a complementary curved surface. Groove 54 is formed in drive housing 19. Arm 46, likewise, has an end portion 56 with a curved surface that fits into groove 54. It can be appreciated that retainer 42 is supported between rubber plug 50 and surfaces of groove 54 on drive housing 19.

Figure 2:
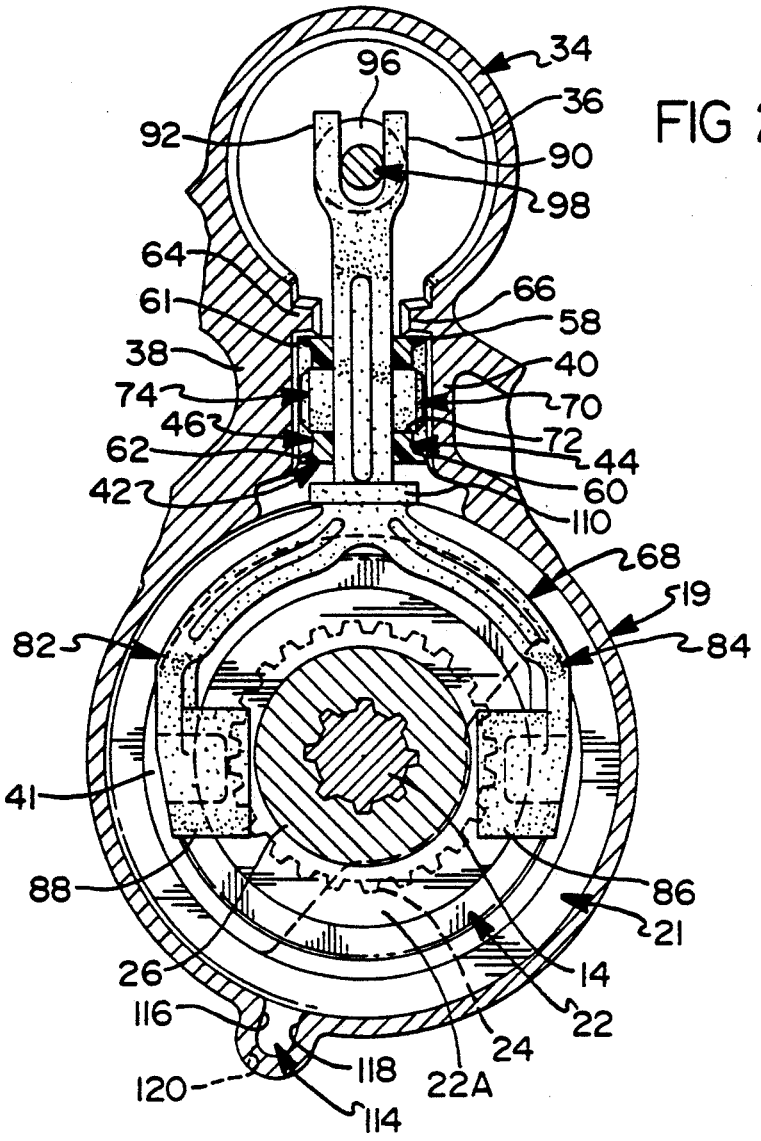
FIG. 2 is a sectional view taken along line 2—2 of FIG. 1.
Figure 3:
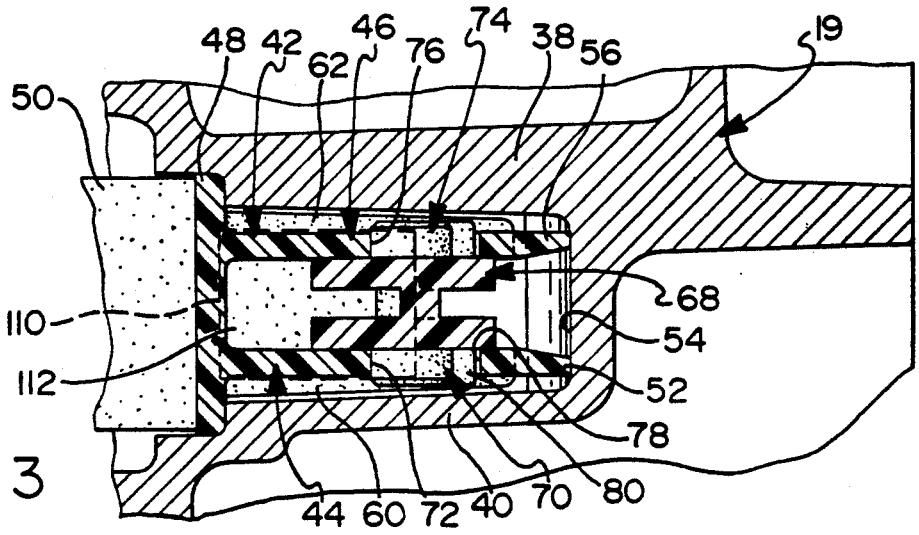
FIG. 3 is a sectional view taken along line 3—3 of FIG. 1.

As can be seen in FIG. 2, the arm 44 has two longitudinally extending ribs 58 and 60. These ribs extend or project toward the inner surface of wall 40 and are slightly spaced from the wall surface. Rib 60 is also shown in FIG. 3. Further, as can be seen in FIG. 2, arm 46 also has two longitudinally extending spaced ribs 61 and 62. These ribs extend or project toward the inner surface of wall 38 and are slightly spaced from the wall surface. Rib 62 is also shown in FIG. 3.

Located adjacent the upper ends of drive housing walls 38 and 40 are inwardly projecting ribs 64 and 66. Rib 64 is located slightly above rib 61 on retainer 42 and rib 66 is located slightly above rib 58 on retainer 42. Rib 64 is shown in FIGS. 1 and 2 and FIG. 1 shows a side outline of rib 64. Rib 66 has the same shape as rib 64.

The retainer 42 pivotally supports a shift lever generally designated as 68. A part of the shift lever 68 is disposed between arms 44 and 46 of retainer 42. The shift lever 68 has a boss 70 that is located in a hole or opening 72 found in arm 44. The shift lever has another boss 74 located in hole or opening 76 formed in arm 46. Hole 72 is primarily circular but has a radially extending slot 78. The boss 70 has a radially extending rib or projection 80 located in slot 78. Boss 74 also has a rib that is positioned in a slot that forms a part of hole 76. The purpose of the ribs and slots is to prevent the lever 68 from being assembled to the retainer in a position that is backwards to its proper position. Insofar as this invention is concerned, the bosses could be completely circular and the openings in the retainer arms that receive the bosses could be completely circular.

The lower end of shift lever 68 has two arms 82 and 84, as shown in FIG. 2. Arm 84 has an end portion 86 that is located between the surface 28A of disk 28 and surface 22A of overrunning clutch 22, as shown in FIG. 1. Arm 82 has an end portion 88 which is, likewise, positioned between surfaces 28A and 22A. It can be appreciated that when shift lever 68 is pivoted counter-clockwise in FIG. 1, the portions 86 and 88 will engage surface 22A of clutch 22 to push the overrunning clutch 22 and pinion 24 to the right, in FIG. 1, to a position where pinion 24 will mesh with the ring gear of the engine. Clockwise movement of shift lever 68 causes surface 28A to be engaged by shift lever portions 86 and 88, thereby causing the pinion 24 to be pulled out of mesh with the engine ring gear.

The upper end of shift lever 68 has two arms 90 and 92 that are located respectively between annular surfaces 94 and 96 of a shift lever actuator rod 98. Rod 98 is moved by an armature or plunger 100 of a solenoid 102. The armature 100 has a bore and a part of rod 98 is located in the bore. Rod 98 has a flange 104 and a jump spring 106 is disposed between flange 104 and an annular part 108 that is secured to armature or plunger 100.

When the coil of solenoid 102 is energized, armature 100 is moved to the left in FIG.1, thereby causing shift lever 68 to pivot counter-clockwise and causing pinion 24 to be moved into mesh with the ring gear of an engine. When the coil of solenoid 102 is deenergized, another spring in the solenoid (not illustrated) causes the armature 100 to move to the right in FIG. 1 and back to its at-rest position, shown in FIG. 1. As armature or plunger 100 moves to right, lever 68 is pivoted clockwise to cause pinion 24 to be moved out of mesh with the engine ring gear and back to its at-rest position shown in FIG. 1.

The shift lever 68 has an integral flap or plate portion designated as 110. The outline of plate or flap 110 is shown in dotted lines in FIG. 3. In the at-rest position of shift lever 68, shown in FIG. 1, it can be seen from FIG. 3 that the plate 110 covers the space between or area 112 between arms 44 and 46 of retainer 42. The plate or flange 110 tends to prevent upward flow of foreign material, such as water, from passing through space 112 and then into solenoid compartment 36.

The lower end of drive housing 19 has a drain channel 114 that has internal side surfaces 116 and 118. The ends of channel 114 are open to drain openings or slots 120 and 122 that extend through a lower wall of drive housing 19.

The purpose of drain channel 114 and drain openings 120 and 122 is to allow water that is thrown or splashed into drive housing 19 through access opening 32 to be drained out of housing 19. Thus, drain openings 120 and 122 form a path for draining water from the interior of a portion of housing 19. Further, drain channel 114 operates as a sump and water collected in drain channel 114 flows out of housing 19 through openings 120 and 122.

The purpose of the ribs 58, 60, 61 and 62 on retainer 42 and the drive housing ribs 64 and 66 will now be described. Any foreign matter, such as water, that attempts to move upwardly, in FIG. 1, is impeded from flowing into solenoid compartment 36. Thus, the ribs 60 and 58 and the ribs 62, 61 on retainer 42 tend to block upward flow of water into compartment 36. Further, any water that makes it past, for example, ribs 60 and 58 tends to be blocked by drive housing rib 66. Ribs 58 and 66 overlap and they therefore form a labyrinth type of seal. What has just been described applies to ribs 62 and 61 on retainer 42 and drive housing rib 64.

The embodiments of the invention in which an exclusive property or privilege is claimed are defined as follows:

1. An engine starter comprising, a drive housing, said drive housing having a first housing portion defining a solenoid compartment and a second housing portion defining a starter drive compartment, a pair of spaced walls connecting said first and second housing portions, a shift lever retainer disposed between said spaced walls, a shift lever pivotally supported by said retainer, said shift lever having a first portion located in said solenoid compartment and a second portion located in said starter drive compartment, a solenoid attached to said first housing portion of said drive housing, said solenoid having a plunger that is connected to said first portion of said shift lever, a shaft located in said starter drive compartment, a starter drive supported by said shaft including a pinion gear, said second portion of said shift lever connected to said starter drive, said second housing portion of said drive housing having an opening that permits said pinion gear to be meshed with the ring gear of an engine, and means for impeding the passage of foreign material, such as water, from said starter drive compartment to said solenoid compartment, said last named means comprising at least one rib on said retainer, said rib projecting outwardly toward an internal surface of one of said pair of spaced walls.

2. The engine starter according to claim 1 where one of said spaced walls of said drive housing has a drive housing rib that extends inwardly from an internal surface of said spaced wall, said drive housing rib being positioned adjacent said rib on said retainer.

3. The engine starter according to claim 1 where said retainer has two opposed ribs, one of said ribs extending outwardly toward an internal surface of one of said spaced walls and the other rib extending outwardly toward an internal surface of the other of said spaced walls.

4. The engine starter according to claim 1 where said retainer has two opposed ribs, one of said ribs extending outwardly toward an internal surface of one of said spaced walls and the other rib extending outwardly toward an internal surface of the other of said spaced walls, each of said spaced walls having a drive housing rib that extends inwardly, each drive housing rib being positioned adjacent a respective rib on said retainer.

5. An engine starter comprising, a drive housing, said drive housing having a first housing portion defining a solenoid compartment and a second housing portion defining a starter drive compartment, a pair of spaced walls connecting said first and second housing portions, a shaft lever retainer disposed between said spaced walls, said shift lever retainer having a pair of spaced arms, a shift lever pivotally supported by said retainer having a portion thereof disposed between said arms, said shift lever having a first portion located in said solenoid compartment and a second portion located in said starter drive compartment, a solenoid attached to said first housing portion of said drive housing, said solenoid having a plunger that is connected to said first portion of said shift lever, a shaft located in said starter drive compartment, a starter drive supported by said shaft including a pinion gear, said second portion of said shift lever connected to said starter drive, said second housing portion of said drive housing having an access opening that permits said pinion gear to be meshed with the ring gear of an engine, and a plate member carried by said shift lever located adjacent the side of said retainer that faces said starter drive compartment, said plate member covering at least a portion of the space between said arms when said shift lever is in an at-rest position to thereby provide a barrier for the passage of foreign material, such as water, from said starter drive compartment into said solenoid compartment through said space in said arms.

6. An engine starter comprising, a drive housing, said drive housing having a portion defining a starter drive compartment, a shaft located in said starter drive compartment, a starter drive including a pinion gear supported by said shaft located in said starter drive compartment, an access opening in said drive housing which is located to permit said pinion to be moved into mesh with the ring gear of an engine, and means for draining water from said starter drive compartment that has entered said starter drive compartment through said access opening, said last named means comprising first and second spaced drain opening formed in said drive housing, said first and second drain openings being connected by an axially extending drain channel that is formed in said drive housing.

* * * * *